US005665039A

United States Patent [19]

Wasserman et al.

[11] Patent Number: 5,665,039

[45] Date of Patent: Sep. 9, 1997

[54] EXCERCISE AND/OR THERAPY APPARATUS HAVING AN IMPELLER FOR USE IN A POOL OF LIQUID

[75] Inventors: Jack F. Wasserman; Frank H. Speckhart, both of Knoxville, Tenn.; Alan Scott; Wil Siersma, both of Carbondale, Colo.

[73] Assignee: Hydroforce, Inc., Basalt, Colo.

[21] Appl. No.: 638,499

[22] Filed: Apr. 26, 1996

[51] Int. Cl.[6] ..... A63B 31/00; A63B 69/16; A63B 22/06

[52] U.S. Cl. ..... 482/111; 482/58

[58] Field of Search ..... 482/111, 57, 58, 482/73; 182/97, 93; 416/181, 186 R

[56] References Cited

U.S. PATENT DOCUMENTS

| | | |
|---|---|---|
| 4,162,788 | 7/1979 | Turnier . |
| 4,480,829 | 11/1984 | Yacoboski . |
| 4,776,581 | 10/1988 | Shepherdson . |
| 4,784,385 | 11/1988 | D'Angelo . |
| 5,060,935 | 10/1991 | Dunn et al. . |
| 5,135,448 | 8/1992 | Dunn et al. . |
| 5,195,936 | 3/1993 | Mao . |
| 5,316,532 | 5/1994 | Butler . |
| 5,354,253 | 10/1994 | Awbrey et al. . |

OTHER PUBLICATIONS

Marks, Standard Handbook for Mechanical Engineers, McGraw Hill Book Co.

*Primary Examiner*—Richard J. Apley
*Assistant Examiner*—William LaMarca
*Attorney, Agent, or Firm*—Michael E. McKee

[57] ABSTRACT

An exercise or therapy apparatus for use in a pool of water utilizes a stationary frame and an impeller section including a user-operable impeller wheel rotatably attached to the frame for rotation about an axis of rotation. Pedals are connected to the impeller wheel enabling the turbine wheel to rotate about its axis of rotation in conjunction with the movement of the user's feet as a cycle-type exercise or therapy device. The impeller section includes an inlet positionable within the water of the pool, and the impeller wheel is adapted to draw a stream of water into the inlet of the impeller wheel as the impeller wheel is rotated about its axis of rotation. A valve is associated with the impeller section for controlling the quantity of the stream of water which is permitted to flow into the impeller section by way of the inlet when the impeller wheel is rotated to thereby alter the resistance to the rotation of the impeller wheel.

15 Claims, 4 Drawing Sheets

EXCERCISE AND/OR THERAPY APPARATUS HAVING AN IMPELLER FOR USE IN A POOL OF LIQUID

BACKGROUND OF THE INVENTION

This invention relates generally to exercise and therapy apparatus and relates, more particularly, to such an apparatus which is positionable within a liquid medium, such as water, and utilizes the liquid medium to resist or help generate motions of an individual performing exercises with the apparatus.

An exercise apparatus with which this invention is to be compared includes a rotatable device, such as a paddle wheel, which is intended to be rotated by a user while the device is positioned within water. Examples of such apparatus which employ a water-submersible pedal-operated paddle wheel and wherein the resistance to the exercise motion is provided by the water within which the paddle wheel is submerged are shown and described in U.S. Pat. Nos. 4,162,788, 4,776,581 and 4,784,385.

It is an object of the present invention to provide a new and improved exercise or therapy apparatus positionable within a liquid medium so that the liquid medium resists motions of an individual performing an exercise or therapy routine with the apparatus.

Another object of the present invention to provide such an apparatus wherein the degree of resistance offered by the liquid medium to the exercise motions of the individual can be altered or wherein the motions generated with the apparatus for moving the limbs of an individual during a therapy routine can be altered.

Still another object of the present invention is to provide such an apparatus which is embodied and operates as a cycle-type exercise or therapy device.

Yet another object of the present invention is to provide such an apparatus which, when embodied as a cycle-type exercise or therapy device, includes pedals against which the feet of the user are snugly maintained during use of the device.

One more object of the present invention is to provide such an apparatus having a construction which, when positioned within water, resists any appreciable side-to-side shift as a cycle-type exercise or therapy routine is performed with the apparatus.

Another object of the present invention is to provide such an apparatus which is uncomplicated in construction, yet effective in operation.

SUMMARY OF THE INVENTION

This invention resides in an exercise or therapy apparatus for use in a pool of liquid wherein the pool has walls.

The apparatus includes a frame positionable in a relatively stationary condition with respect to the walls of the pool, an impeller section including an impeller rotatably attached to the frame for rotation relative thereto about an axis of rotation in conjunction with motions of a user's limbs. The impeller wheel is adapted to move the liquid of the pool through the impeller section as the wheel is rotated and includes means defining an inlet through which a stream of the liquid is drawn into the impeller section during the rotation of the impeller wheel.

The apparatus also includes means associated with the impeller section for controlling the quantity of the stream of the liquid drawn into the inlet of the impeller wheel to thereby alter the resistance to the rotation of the impeller wheel.

DETAILED DESCRIPTION OF THE ILLUSTRATED EMBODIMENTS

Figure 1:
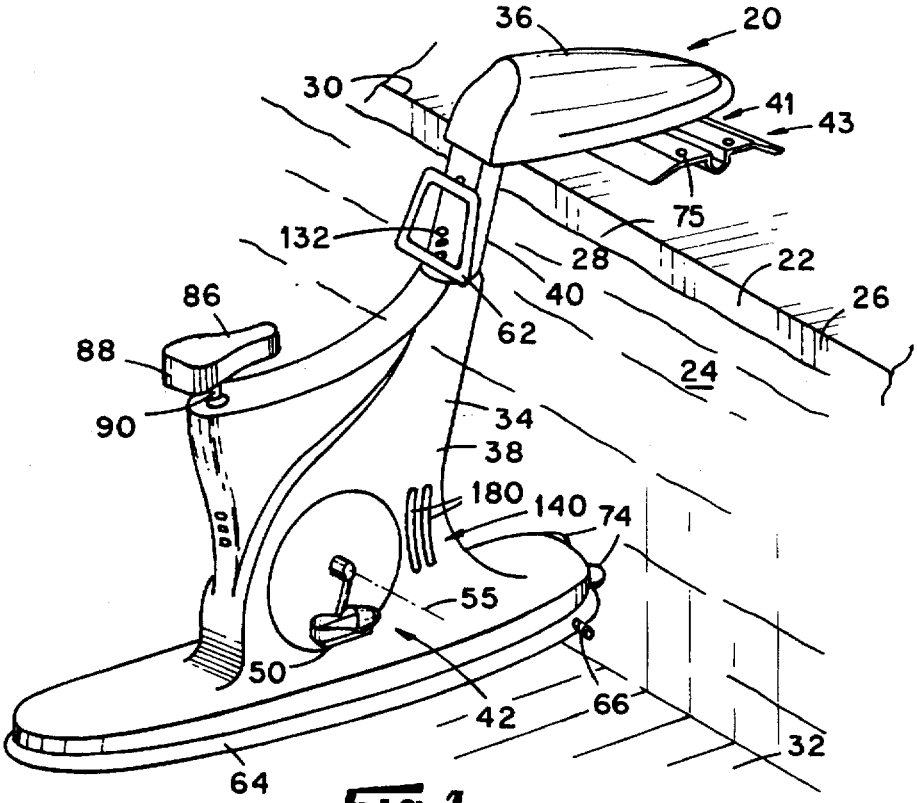
FIG. 1 is a perspective view of an embodiment of an apparatus shown positioned within a pool of water for use.
Figure 2:
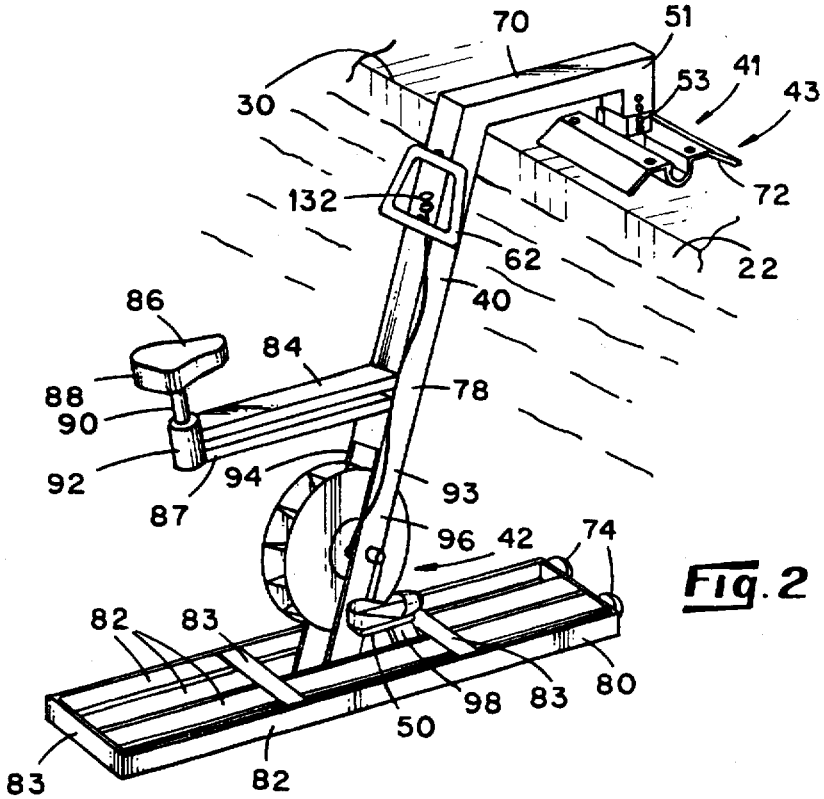
FIG. 2 is a perspective view of the FIG. 1 embodiment, shown with its outer shell removed therefrom.

Turning now to the drawings in greater detail, there is shown in FIGS. 1 and 2 an embodiment, generally indicated 20, of an exercise apparatus shown positioned within an environment of intended use. In particular, the exercise apparatus 20 is shown anchored adjacent a side of a pool 22 of water 24 so that a substantial portion of the apparatus 20 is positioned within the water 24 of the pool 22. The depicted pool 22 includes a planar, substantially vertically-disposed sidewall 26 and a flat, horizontal walkway 28 which joins the sidewall 26 along an upper edge 30 of the pool 22, and a bottom 32. The apparatus 20 includes a frame 40 (best shown in FIG. 2) which is attached to the walkway 28 in a stationary relationship with the sidewall 26 and bottom 32 of the pool 22 and an impeller section 42 mounted upon the frame 40 so as to be positioned entirely beneath the upper level of the pool water 24.

Although the apparatus 20 is shown and described herein for use during the performance of an exercise routine wherein the movements of an individual effect a corresponding movement of selected components of the apparatus 20, it will be understood that the apparatus 20 can be used during the performance of a therapy routine wherein motions generated with selected components of the apparatus 20 effect corresponding movements of an individual. Accordingly, the principles of the present invention can be variously applied.

The frame 40 is housed within an outer shell 34 having an upper portion 36 which is positioned about the upper portion of the frame 40 and a lower portion 38 which substantially encloses the principal operating components of the impeller section 42. The shell 34 renders the apparatus 20 relatively attractive in appearance and, as will be apparent herein, its lower portion 38 helps to stabilize the apparatus 20 during operation. The shell 34 of the depicted embodiment 20 is comprised of molded plastic sections which are attached about the frame 40 so as to provide a hollow skin thereabout.

Figure 3:
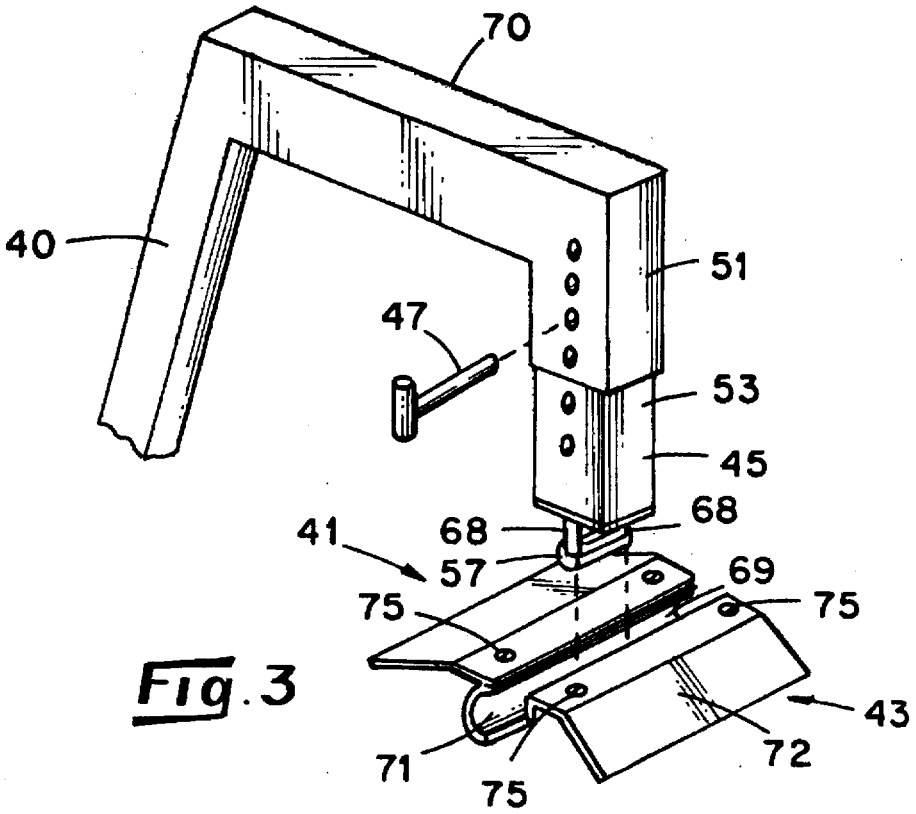
FIG. 3 is a perspective view of a fragment of the frame of the FIG. 1 apparatus, shown exploded.

For purposes of securing the apparatus 20 in place within the pool 22 and with reference to FIG. 3, the depicted apparatus 20 includes an attachment system 41 including connectable means, generally indicated 43, which is connected to the walkway 28 of the pool 22 in a stationary condition with respect thereto and a downwardly-depending section 45 associated with the frame 40 which cooperates with the connectable means 43 in a manner which permits the remainder of the frame 40 to be supported from the walkway 28 and over the pool edge 30. In this connection, the frame 40 includes an upper portion having an horizontally-oriented beam 70 and a vertical (hollow) section 51 joined to an end of the beam 70 so as to be disposed generally over the walkway 28.

The downwardly-depending section 45 of the depicted embodiment 20 includes a square channel section 53 which is slidably received within the interior of the vertical section 51 and which is retained therein with a pin 47 extending through aligned openings provided in the sections 51 and 53. The vertical position of the vertical section 51 (and consequently the remainder of the frame 40) can be adjusted by removing the pin 47 from one set of aligned openings, shifting the section 51 vertically with respect to the channel section 53 to align an alternative set of openings provided in the sections 51 and 53 and then repositioning the pin 47 within the aligned openings.

Figure 3A:
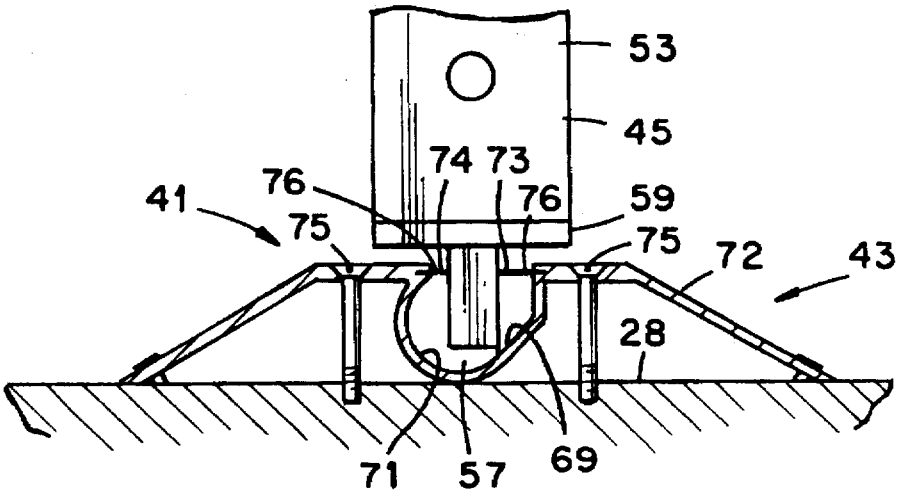
FIG. 3*a* is a side elevational view of a portion of the FIG. 3 fragment, shown assembled.

With reference to FIG. 3*a*, the downwardly-depending section 45 also includes an elongated, linear member 57 which is attached to the section 53 by way of an end cap 59 and a pair of side posts 68 arranged on opposite sides of the member 57. The linear member 57 is substantially circular in form as a path is traced about a major portion of its circumference, and as will be apparent herein, cooperates with the connectable means 43 to suspend the remainder of the frame 40 from the pool edge 30 in a desired manner.

The connectable means 43 of the system 41 is in the form of an extruded member 72 fixedly secured to the walkway 28 with screws 75 and having an upper surface within which is formed a generally upwardly-opening recess 69. This recess 69 is adapted to accept the elongated member 57 of the downwardly-depending section 45 when the member 57 is lowered sideways therein. To this end, the recess 69 has an internal surface portion 71 adjacent its bottom which is shaped generally complementary to the cylindrical outer surface of the member 57 so that when received therein, the member 57 is nestingly received by the recess 69 and so that the downwardly-depending section 45, and thus the remainder of the frame 40, is permitted to pivot about the member 57 between two alternative positions. The member 57 is releasably secured within the recess 69 with a thin plate-like member 73 slidably positioned within opposing grooves 76 formed within the surface of the recess 69 and generally above the member 57.

With reference to again to FIGS. 1 and 2, the lower portion of the frame 40 is provided with a pair of cushioned, spaced-apart feet 74 (FIGS. 1 and 2) which are adapted to abut the sidewall 26 of the pool 22 as the frame 40 tends to pivot about the elongated member 57 under the weight of the frame 40.

With reference again to FIG. 2, the frame 40 also includes a main beam 78 which is joined at one (i.e. an upper) end to the end of the beam 70 opposite the securement system 41 so as to extend generally downwardly therefrom. Supported at the lower end of the beam 78 is a substantially rectangular base section 80 which is arranged so that its planar arrangement is substantially oriented in a horizontal plane. The base section 80 includes a plurality of parallel members 82 extending lengthwise of the section 80 and a plurality of cross members 83 which are joined to and extend across the parallel members 82. The aforementioned feet 74 are attached to and are directed away from the end of the base section 80 closest the pool sidewall 26 for abuttingly engaging the sidewall 26 when the apparatus 20 is operatively positioned within the pool 22 as illustrated in FIG. 1. Once covered by the lower portion of the shell 34 (FIG. 1), the base 80 provides a platform upon which a user may stand when mounting or dismounting the apparatus 20.

Still further, the frame 40 includes a linear arrangement of members 84 joined at one end to the main beam 78 so as to be cantilevered therefrom and a seat assembly 86 supported at the end, indicated 87, of the members 84 opposite the main beam 78. The seat assembly 86 includes a seat 88 and an accompanying support post 90, and a sleeve 92 is attached to the end 87 of the members 84. The support post 90 is slidably received by the sleeve 92 and is adjustable in position therein to accommodate an adjustment in the height of the seat 88 relative to the remainder of the frame 40. The apparatus 20 is intended to operate as a cycle device in that during use, an individual sits upon the seat 88 and rotates rotatable portions of the impeller section 42, described herein, with his feet.

The frame 40 also includes a set of handlebars or grips 62 which are mounted forwardly of the seat 88 to enhance the stability of the user as he sits upon the seat 88 and rotates portions of the impeller section 42 with his feet. In the depicted apparatus 20, the grips 62 are somewhat in the shape of a trapezoid having two opposite side portions and are fixedly attached to the main beam 78 so that the grips 62 are maintained in a stationary condition with respect thereto.

Each component of the attachment system 41 and the beams (and other support members) of the frame 40 are comprised of a suitable material, such as aluminum, but other materials can be used. A frame 40 constructed primarily of aluminum has been found to weigh no more than about one-hundred pounds, and since the apparatus 20 may be required to be, on occasion, physically removed from and subsequently re-installed within the pool, its lightweight nature is advantageous in this respect. To facilitate the raising and lowering of the frame 40 within the pool 22, an air-inflatable envelope 64 (best shown in FIG. 1) may be secured beneath the underside of the base section 80. A valve 66 associated with the envelope 64 permits air to be pumped into the envelope with, for example, an air compressor (not shown) positioned upon the walkway 28, and the air pumped into the envelope 64 will render the frame 40 considerably lighter and easier to manipulate when positioning the frame 40 within the water 24 of the pool 22.

In order to mount the apparatus 20 within the pool 22, the extruded member 72 of the attachment system 41 is initially secured along the edge of the pool 22 with the screws 75. The frame 40 is then lowered into the water of the pool 22, and the main beam 78 of the frame 40 is manipulated so that the upper beam 70 is hooked within the recess 69 of the extruded member 72 by way of the elongated member 72, and the elongated member 57 is releasably secured within the recess 69. With the main beam 78 of the frame 40 hooked to the extended member 72 in this manner, the frame 40 is subsequently lowered into the water (as the frame 40 pivots about the member 57) until the feet 74 of the frame 40 abut the sidewall 26 of the pool 22. If necessary, adjustments can be made by way of the sections 51 and 53 to appropriately position the base section 80 in a substantially horizontal orientation for use.

As best viewed in FIG. 2, the impeller section 42 is mounted within the main beam 78 for rotation with respect thereto. In this connection, the lower section of the beam 78 is formed so as to provide a bifurcated section 91 along the length thereof having two side sections 94, 96, and the principal operating components of the impeller section 42 are positioned between and supported by the two side sections 94, 96. An additional brace member 98 is joined between each side section 94 or 96 and the base section 80 to aid in the support of the impeller section 42 by the frame 40.

Figure 4:
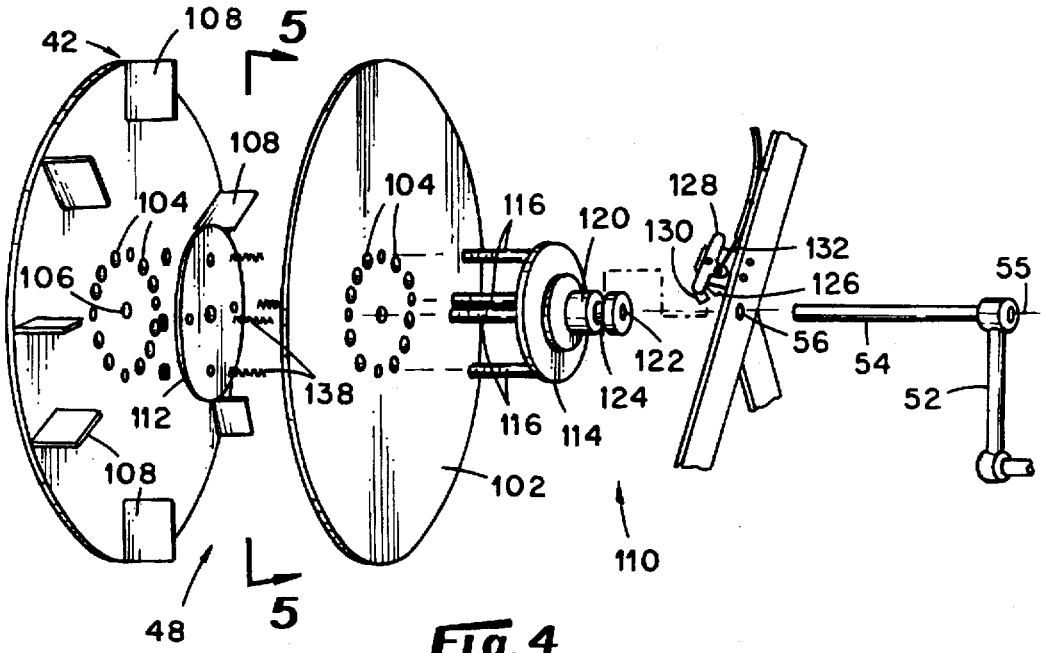
FIG. 4 is a perspective view of the impeller section of the FIG. 1 apparatus, shown exploded.

With reference to FIG. 4, the impeller section 42 includes a impeller wheel 48 which is rotatably mounted within the frame 40 and a set of pedals 50 which are connected to the wheel 48 in a manner which enables the wheel 48 to be rotated by a user seated upon the seat 88. More specifically, the pedals 50 are connected to the wheel 48 with an axle 54 which is rotatably mounted within aligned openings 56 (FIG. 5) formed in the side sections 94, 96 and cranks 52 joined between the axle 54 and the pedals 50 in a conventional manner to effect rotation of the axle 54 about a rotation axis 55 as the pedals 50 are rotated about the axis 55.

With reference still to FIG. 2, the impeller wheel 48 includes a pair of opposing side plates 100, 102 which are arranged in a spaced and parallel relationship with one another. Each side plate 100 or 102 is circular in form and is provided with a central opening 106 through which the axle 54 is received for rotation therewith and a plurality of circular openings 104 adjacent its center. As the impeller wheel 48 is rotated, water is drawn into the impeller wheel 48 by way of the openings 104 provided adjacent the center of the plates 100, 102 and is directed generally radially outwardly of the impeller wheel 48 along the periphery of the side plates 100, 102. Thus, the openings 104 provide the inlet of the impeller wheel 48 through which a stream of water is drawn into the impeller section 42 during the rotation of the impeller wheel 48. The turbine wheel 48 also includes a plurality of substantially flat blades 108 which are arranged about the rotation axis so as to extend generally radially outwardly thereof and which are joined to each of the side plates 100, 102. Thus, the blades 108 help to fixedly secure the side plates 100, 102 to one another.

As the turbine wheel 48 is rotated during operation of the apparatus 20, water is directed generally radially outwardly of the rotation axis by the rotating blades 108 and is drawn into the spacing between the side plates 100, 102 through the central openings 104 thereof in a steady flow operation. It will be understood, however, that as a stream of water is moved through the impeller section 42 during rotation of the turbine wheel 48, work must be expended by the user to rotate the impeller wheel 48, and in general, the greater the stream of water that is moved through the turbine section 42 during rotation, the greater the work that must be expended by the user.

It is a feature of the apparatus 20 that it includes means, generally indicated 110, for controlling the quantity of the stream of water drawn into the inlet of the impeller wheel 48 during rotation of the wheel 48. In the depicted embodiment 20, such means 110 includes means for restricting the flow of water through the openings 104 and varying the degree of restriction to the flow through the openings 104. In the depicted embodiment 20, such restricting means operates to alter the coverage of the openings 104 between partially covered and fully covered conditions to thereby alter the capacity of the impeller section 42 to move water therethrough at a preselected (i.e. given) rate of revolution of the impeller wheel 48. By reducing the coverage of the openings 104, the work required in order to rotate the wheel 48 (at a preselected rate of rotation) is increased. Conversely, by increasing the coverage of the openings 104, the work required to be expended in order to rotate the wheel 48 (at the preselected rate of rotation) is decreased. Thus, by changing the degree, or amount, by which the openings 104 are covered, the resistance to rotation of the impeller wheel 48 is altered thereby altering the amount of energy that the user of the apparatus 20 must expend in order to rotate the impeller wheel 48 by way of the pedals 50.

Figure 5:
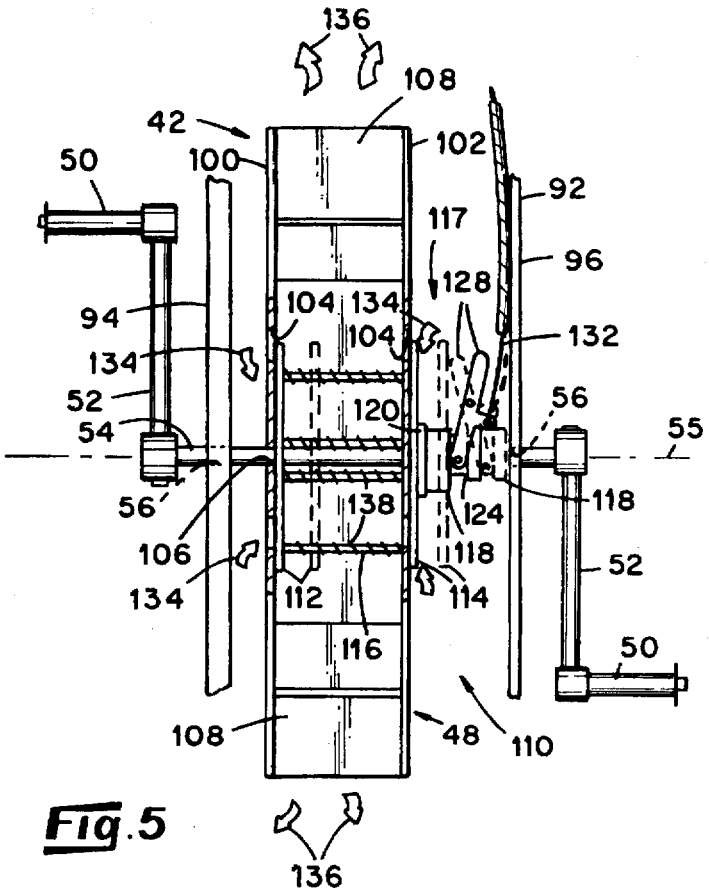
FIG. 5 is a cross-sectional view of a fragment of the FIG. 1 apparatus as viewed about along line 5—5 of FIG. 4.

With reference to FIGS. 4 and 5, the controlling means 110 includes a pair of valve plates 112, 114 mounted adjacent the openings 104 for movement toward and away from the openings 104 along a path disposed generally parallel to the rotation axis 55. Each valve plate 112 or 114 is generally circular in form, includes a central opening through which the axle 54 extends and is fixedly joined to the other plate 114 or 112 with a plurality of linear struts 116 which extend through suitable holes provided in the plate 114 and rigidly hold the plates 112, 114 in substantially parallel relationship. Thus, as the valve plates 112, 114 are moved toward and away from the plate openings 104 in a manner described herein, the plates 112, 114 move in unison.

The controlling means 110 also includes means, generally indicated 117, associated with the valve plates 112, 114 for moving the plates 112, 114 toward and away from the plate openings 104. In the depicted apparatus 20, the moving means 117 includes a hub member 118 including a body 120 joined to the plate 114 for rotation therewith wherein the body 120 includes a bore 122 through which the axle 54 is rotatably received and an annular groove 124 formed about the body 120. A pillow block 126 is secured, as with screws, to the side section 96 of the beam 78, and a Y-shaped member 128 is pivotally secured to the block 126 for pivotal movement relative thereto between a position illustrated in solid lines in FIG. 5 and a position illustrated in phantom in FIG. 5. A cam member 130 is attached to a first leg of the Y of the Y-shaped member 128 and is positioned within the annular groove 124 provided about the hub member body 120. By pivoting the Y-shaped member 128 between the FIG. 5 solid and phantom-line positions by, for example, a user-actuated cable 132 joined between a second leg of the Y-shaped member 128 and a location disposed adjacent the grips 62 (FIG. 1), the cam member 130 urges the hub member 118 rightwardly and leftwardly, as viewed in FIG. 5, along the length of the axle 54 between the position illustrated in solid lines in FIG. 5 and the position illustrated in phantom in FIG. 5. As the hub member 118 is rotated about the rotation axis in conjunction with the impeller wheel 48, the surfaces of the annular groove 124 are permitted to slide along the surfaces of the cam member 130. Accordingly, the cam member 130 is sized so as to be loosely received between the walls of the groove 124.

It follows from the foregoing that by shifting the hub member 118 along the axle 54 between the solid and phantom-line positions of FIG. 5, each plate 112 or 114 moves toward or away from the openings 104 provided in the corresponding plate 102 or 104 thereby altering the coverage of the plate openings 104. For example, when the hub member 118 is positioned in its leftwardmost position, as viewed in FIG. 5, the openings 104 of both plates 100, 102 are completely covered by the valve plates 112, 114. It is in this fully-covered condition that the impeller wheel 48 is the easiest to rotate because no water is permitted to be drawn through the impeller wheel openings 104. Conversely, when the hub member 118 is positioned toward the right, as viewed in FIG. 5, of the fully-covered condition, the openings 104 of the plates 100, 102 are partially uncovered so that flow communication is established through the openings 104 between the interior of the impeller wheel 48 and the pool 22. It is in this partially-covered condition that rotation of the impeller wheel 48 effects a draw of water through the openings 104 (along paths, for example, depicted by the arrows 134) for subsequent expulsion about the periphery thereof (along paths, for example, depicted by the arrows 136), and a greater expenditure of energy is required to rotate the wheel 48 than is the case when the openings 104 are fully covered.

Along these lines, the closer that the hub member 118 is moved toward the wheel 48 (i.e. in a leftwardly direction as viewed in FIG. 5) along the axle 54, the greater the degree that the openings 104 are covered by the plates 112, 114 and the lesser the amount of work required to rotate the impeller wheel 48. Accordingly, a user of the apparatus 20 can preselect or alter the resistance to his pedaling motion by setting or altering, as desired, the position of the Y-shaped member 128 relative to the pillow block 126 by way of the cable 132. To bias the movement of the hub member 118 rightwardly, as viewed in FIG. 5, along the axle 54, tension springs 138 are positioned about the struts 116 and joined between the valve plate 112 and the side plate 102.

Figure 6:
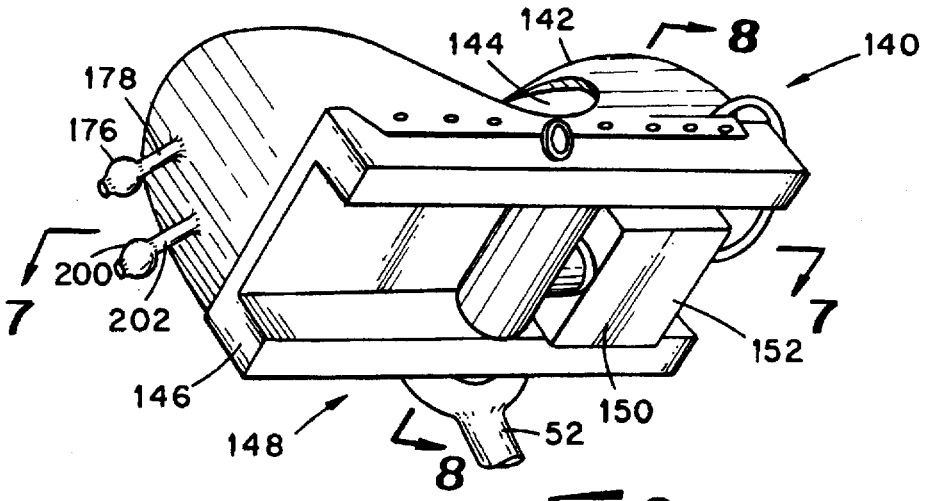
FIG. 6 is a fragmentary perspective view of one of the pedals of the FIG. 1 apparatus as seen generally from below in FIG. 1.

It is another feature of the apparatus 20 that it include means, generally indicated 140, associated with the pedals 50 for firmly holding the user's feet against the surface of the pedals 50 in a captured condition during use of the apparatus 20. In the depicted apparatus 20 and with reference to FIGS. 6–8, such means 140 includes a distensible envelope in the form of inflatable bladder 142 attached to each pedal 50 and shaped about the pedal body, indicated 146, to encircle the heel of the user's foot and provide with the upper surface of the pedal body 146 an interior opening 144 for accepting the user's foot when inserted toe-first therein. In addition, the bladder 142 is shaped so that upon inflation of the bladder 142, the surface of the bladder 142 engages and presses against the top and across the back of the heel of the user's foot in a manner which snugly holds the foot upon the surface of the pedal body 146. Since the user's foot may be bare when positioned upon the pedal body 146, it is preferable that the outer surface of the bladder 142 be covered with a smooth and relatively soft material.

Figure 7:
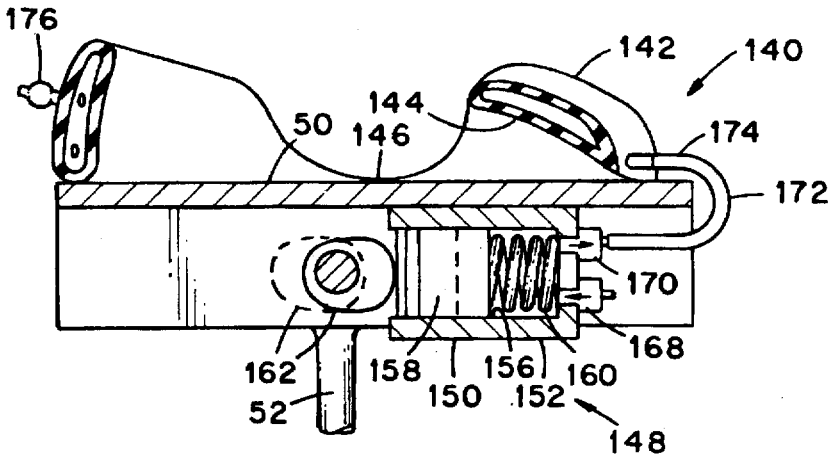
FIG. 7 is a cross-sectional view of the FIG. 6 fragment taken about along line 7—7 of FIG. 6.
Figure 8:
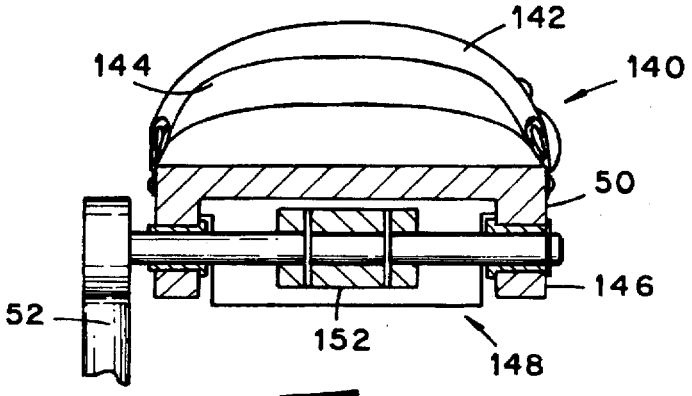
FIG. 8 is a cross-sectional view of the FIG. 6 fragment taken about along line 8—8 of FIG. 6.

Associated with each bladder 142 are means, generally indicated 148, for inflating the bladder 142 during rotation of the pedals 50 about the rotation axis 55. Although such means 148 may take any of a number of forms, the depicted means 148 includes a cam-actuated piston arrangement 150 for pumping water into the bladder 142 in conjunction with the forced rotation of the pedals 50 with the feet. In particular, the pedal body 146 includes a block portion 152 having a cylindrical recess 156 within which a piston 158 is positioned and a compression spring 160 disposed between the bottom of the recess 156 and the piston 158, and a cam member 162 is secured to the crank 52 for rotation therewith. As best shown in FIG. 7, the piston 158 is biased by the spring 160 into contact with the peripheral surface of the cam member 162 so that as the cam member 162 is rotated with the crank 52, the piston 158 is moved between its position illustrated in solid lines in FIG. 7 and its position illustrated in phantom in FIG. 7.

Defined within one end of the block portion 152 of the pedal body 148 are two openings within which are secured check valves 168 and 170. The check valve 168 is adapted to permit only a one-way flow of water into the interior of the recess 156, while the check valve 170 is adapted to permit only a one-way flow of water out of the interior of the recess 156. A flexible pipe 172 is secured between the check valve 170 and an inlet port 174 associated with the bladder 142 for conducting water from the interior of the recess 156 into the bladder 142, and a flow restrictor 176 is associated with a first outlet vent 178 associated with the bladder 142 and a pop-off valve 200 is associated with a second outlet vent 202.

During rotation of the pedals 50 about the rotation axis 55 of the cranks 52, the back and forth movement of the piston 158 along the length of the recess 156 effects a pulling of the water of the pool 22 into the recess interior by way of the check valve 168 and a pumping of the water out of the recess interior into the bladder 142 by way of the check valve 170 and pipe 172. This pumping action of the piston 158 expands, i.e. inflates, the bladder 142 across the user's foot so that the user's foot is snugly maintained against the surface of the pedal body 146. It will be understood that the internal pressure of the bladder 142 could be increased by this pumping action beyond the pressure needed (or desired) to be sensed within the bladder 142. To therefore protect the bladder 142 from the high pressures which could otherwise be developed within the bladder 142, the flow restrictor 176 helps to prevent a build up in the internal pressure of the bladder 142 in excess of an acceptable pressure level and the pop-off valve 200 is adapted to permit the flow of water through the second vent 202 if the internal pressure of the bladder 172 exceeds a preselected pressure, e.g. about 5.0 psig. The magnitude of the flow restriction provided by the flow restrictor 176 is selected to provide a desired internal pressure therein intended to sufficiently expand the bladder 142 and maintain the bladder 142 in an expanded condition about to thereby capture the user's foot.

When preparing to use the apparatus 20, the user climbs into the water and onto the seat 88 (FIG. 1). The user then positions his feet (one-at-a-time) upon the pedals 50 so that each foot is positioned within the opening 144 provided between the upper surface of the pedal body 146 and the surface of the bladder 142. Each bladder 142 is in a deflated condition at the outset of an exercise routine so that the opening 144 readily accepts the foot of the user when inserted toe-end-first therein. The user then begins to rotate the pedals 50 about the rotation axis 55 which, by way of the cam-actuated piston arrangement 150, increases the internal pressure of and thereby expands the bladders 142 about and across the user's feet. The pop-off valve 200 is advantageous in that it speeds up the build-up of the internal pressure within the bladder 142 if, for example, the pedals 50 are rotated relatively slowly about the rotation axis 55 yet permits a prompt discharge of water from the bladder 142 if, for example, the pedals 50 are rotated so rapidly that the pressure build-up within the bladder 142 is not adequately handled by the flow restrictor 176.

Upon completion of an exercise routine performed with the apparatus 20, the user will, of course, cease to rotate the pedals 50 about the axis 55 and the internal pressure of the bladders 142 will be permitted to equalize (by way of the vent 178) with that of the surrounding water so that the bladders 142 returns to the deflated condition and relieve the bladder-applied pressure upon the feet. Thus, following cessation of the rotation of the pedals 50 about the axis 55 and a release of the foot by the bladder 142, the user may withdraw his feet from the openings 144 associated with the pedals 150.

Another advantage of the apparatus 20 relates to the substantially enclosed condition of the impeller wheel 48 by the lower portion 38 (FIG. 1) of the outer shell 34. In particular, the lower portion of the shell 34 includes vents 180 (FIG. 1) through which flow communication is established between the interior of the shell 34 and the water 24 of the surrounding pool 22, but such vents do not reduce the capacity of the lower portion of the shell 38 to maintain the water in a captured condition about the impeller wheel 48. Accordingly, this shell-captured water provides an inertia against any appreciable sideways shifting of the impeller wheel 48 which may otherwise result as the pedals 50 are alternately depressed downwardly during the downstroke of the cycling motion, and the shell is advantageous in this respect. At the same time, however, the frame 40 has been found to permit a limited amount of side-to-side shift of the impeller wheel 48 as the pedal 50 are rotated during use. This limited side-to-side shift provides the user with the feel of an actual bicycle (which tends to shift toward the side thereof corresponding with the pedal being depressed downwardly) and is further advantageous in this respect.

It will be understood that numerous modifications and substitutions can be had to the aforedescribed embodiment 20 without departing from the spirit of the invention. For example, although the impeller wheel 48 of the apparatus 20 has been shown and described as being rotated by pedals 50 mounted for rotation about the same axis of rotation, i.e. the axis 55, as that of the impeller wheel 48, an alternative embodiment of the apparatus may include a set of pedals mounted for rotation about an axis of rotation which is different than the axis of rotation of the impeller wheel. In such an instance and as long as the axes of rotation of the pedals and the impeller wheel are parallel, the impeller wheel may be coupled to the pedals by way of a drive chain in a manner similar to the manner in which rotatable pedals are coupled to the rear wheel of a common bicycle.

Furthermore, the apparatus 20 may include a control computer mounted in, for example, the upper portion 36 (FIG. 1) of the shell 38 and providing a viewable monitor which the user can view while performing his exercise routine with the apparatus 20. Such a monitor may include an LED display appropriately coupled to the impeller wheel 48 to provide a display of the rate of revolution of the impeller wheel 48 and a comparison of the actual rate of revolution to a target, or desired rate of wheel rotation.

Still further and as mentioned earlier, the aforedescribed apparatus 20 can be used for the performance of a therapy routine wherein the feet are forcibly moved by motions generated in conjunction with the rotation of the impeller wheel 48, rather than vise-versa. In such an instance, rotating means, such as a motor, may be operatively connected to the impeller wheel 48 to force the wheel to rotate about its rotation axis during a therapy routine. In either event, the rotation of the impeller wheel 48 effects a corresponding movement of the pedals 50 about the wheel rotation axis 55 or the movement of the pedals 50 about the wheel rotation axis 55 effects a corresponding rotation of the impeller wheel 48, and the restriction of the flow of water into the openings 104 associated with the impeller section 42 is largely responsible for the rate at which the pedals 50 are (or can be) rotated about the wheel rotation axis 55. Accordingly, the aforedescribed embodiment is intended for the purpose of illustration and not as limitation.

We claim:

1. An exercise or therapy apparatus for use with liquid contained within a pool having walls, the apparatus comprising:

a frame positionable in a relatively stationary condition with respect to the walls of the pool; and an impeller section including an impeller wheel rotatably attached to the frame for rotation relative thereto about an axis of rotation in conjunction with movements of a user's limb and having two opposite sides;

the impeller wheel being adapted to move the liquid of the pool through the impeller section as the impeller wheel is rotated as aforesaid and including two opposite side plates wherein each side plate is disposed adjacent a corresponding side of the impeller wheel and defines an inlet for the impeller wheel adjacent the axis of rotation through which a stream of the liquid is drawn into the impeller section during the rotation of the impeller wheel so that as the impeller wheel is rotated as aforesaid and liquid is drawn into the impeller section, a stream of liquid is drawn into the impeller wheel through each of the side plates thereof; and means associated with the impeller section for controlling the quantity of the stream of the liquid drawn into the inlet of each of the impeller side plates during rotation of the impeller wheel;

wherein the inlet defined by each side plate of the impeller wheel includes at least one opening through which the liquid stream is moved as it is drawn into the impeller section and the controlling means includes a valve having a first valve plate which is axially movable toward and away from the one opening provided in one side plate to alter the degree that the one opening of the one side plate is covered by the first valve plate and includes a second valve plate which is axially movable toward and away from the one opening provided in the other side plate to alter the degree that the one opening of the other side plate is covered by the second valve plate so that by axially moving the first and second valve plates toward and away from the openings provided in the side plates as aforesaid, the quantity of the liquid drawn into the impeller section through the impeller side plates during rotation of the impeller wheel is altered.

2. The apparatus as defined in claim 1 wherein the controlling means includes means for axially moving the first and second valve plates toward and away from the openings provided in the side plates as aforesaid.

3. The apparatus as defined in claim 2 wherein the moving means includes means permitting the user of the apparatus to select the axial position of the first and second valve plates relative to the openings provided in the side plates.

4. An exercise or therapy apparatus for use with liquid contained within a pool having walls, the apparatus comprising:

a frame positionable in a relatively stationary condition with respect to the walls of the pool; and an impeller section including an impeller wheel rotatably attached to the frame for rotation relative thereto about an axis of rotation in conjunction with movements of the user's limbs;

the impeller wheel being adapted to move the liquid of the pool through the impeller section through the impeller wheel is rotated as aforesaid and including means defining an inlet through a stream of the liquid is drawn into the impeller section during the rotation of the impeller wheel; and means associated with the impeller section for controlling the quantity of the stream of the liquid drawn into the inlet of the impeller wheel during rotation of the impeller wheel; and means for capturing a limb of the individual for movement thereof in conjunction with the rotation of the impeller wheel about its rotation axis, the limb-capturing means including a distensible envelope positionable adjacent the limb of the individual and means for expanding the envelope to a condition at which the limb is captured by the limb-capturing means so that movements of the limb of the individual effect a corresponding rotation of the impeller wheel about the rotation axis and the rotation of the impeller wheel about the rotation axis effects a corresponding movement of the limb of the individual.

5. The apparatus as defined in claim 1 wherein the pool with which the apparatus is used includes a generally upwardly-facing planar surface which meets one of the pool walls at an edge and wherein the frame includes an abutting portion for abutting the one wall of the pool when operatively positioned within the pool for use of the apparatus, the apparatus further comprising:

means associated with the frame including a downwardly-depending section which is arranged over the generally upwardly-facing surface of the pool when the apparatus is operatively positioned within the pool; and means connectable in a stationary relationship with the generally upwardly-facing planar surface of the pool and having a surface within which is defined an upwardly-opening recess adapted to accept the downwardly-depending section of the associated means so that when the connectable means is connected to the generally upwardly-facing surface of the pool as aforesaid and the downwardly-depending section is accepted by the upwardly-opening recess, the upwardly-opening recess is disposed above the upwardly-facing planar surface of the pool and the frame is supported from the connectable means and over the pool edge so that the abutting portion of the apparatus abuts the wall of the pool for use of the apparatus.

6. The apparatus as defined in claim 5 wherein the upwardly-opening recess of the connectable means is adapted to permit a pivotal movement of the frame of the apparatus between two positions about the downwardly-depending section.

7. An exercise apparatus for use in water contained within a pool having walls, the apparatus comprising:

a frame securable adjacent a wall of the pool and in a relatively stationary condition with respect to the walls of the pool;

an impeller section including an impeller wheel having two opposite sides and which is rotatably attached to the frame for rotation relative thereto about an axis of rotation and further including means enabling the user to rotate the impeller wheel about its axis of rotation;

the impeller wheel being adapted to move the water of the pool through the impeller section as the impeller wheel is rotated by the user as aforesaid and including two opposite side plates wherein each side plate is disposed adjacent a corresponding side of the impeller wheel and defines an inlet opening for the impeller wheel adjacent the axis of rotation through which a stream of the water is drawn into the impeller section so that as the impeller wheel is rotated as aforesaid and liquid is drawn into the impeller wheel, a stream of liquid is drawn into the impeller wheel through each of the side plates thereof; and means associated with the inlet openings of the impeller wheel for regulating the quantity of the stream of water permitted to be drawn into the impeller section by way of both side plates to thereby regulate the resistance encountered by the user in order to rotate the impeller wheel;

wherein the regulating means includes a valve having a first valve plate which is axially movable toward and away from the inlet opening provided in one side plate to alter the degree that the inlet opening of the one side plate is covered by the first valve plate and includes a second valve plate which is axially movable toward and away from the inlet opening provided in the other side plate to alter the degree that the inlet opening of the other side plate is covered by the second valve plate so that by axially moving the first and second valve plates toward and away from the inlet openings provided in the side plates as aforesaid, the quantity of the stream of water which is permitted to be drawn into the impeller section by way of the side plates upon rotation of the impeller wheel is regulated.

8. The apparatus as defined in claim 7 wherein the impeller wheel includes an arrangement of blades which are adapted to move water in a generally radially-outward direction relative to the axis of impeller wheel rotation.

9. A cycle-type exercise or therapy apparatus for use in water contained within a pool having walls, the apparatus comprising:

a frame securable adjacent a wall of the pool and in a relatively stationary condition with respect to the walls of the pool;

an impeller section having two opposite sides and including an impeller wheel rotatably attached to the frame for rotation relative thereto about an axis of rotation and a pair of rotatable pedals associated with the impeller wheel with which the impeller wheel can be rotated about the axis of rotation in conjunction with the movement of the user's feet;

the impeller wheel being adapted to move the water of the pool through the impeller section as the impeller wheel is rotated as aforesaid and including two side plates disposed on the opposite sides of the impeller section wherein each side plate defines an inlet opening for the impeller wheel adjacent the axis of rotation through which a stream of the water is drawn into the impeller section during rotation of the wheel so that as the impeller wheel is rotated as aforesaid and liquid is drawn into the impeller section, a stream of water is drawn into the impeller wheel through each of the side plates thereof; and means associated with the inlet openings of the impeller wheel for regulating the quantity of the stream of water permitted to be drawn into the impeller section by way of the inlet openings provided in both side plates to thereby regulate the resistance encountered by the user in order to rotate the impeller wheel with the pedals;

wherein the regulating means includes a valve having a first valve plate which is axially movable toward and away from the inlet opening provided in one side plate to alter the degree that the inlet opening of the one side plate is covered by the first valve plate and includes a second value plate which is axially movable toward and away from the inlet opening provided in the other side plate to alter the degree that the inlet opening of the other side plate is covered by the second valve plate so that by axially moving the first and second valve plates toward and away from the inlet openings provided in the side plates as aforesaid, the quantity of the stream of water which is permitted to be drawn into the impeller section by way of the inlet openings upon rotation of the impeller wheel is regulated thereby regulating the resistance encountered by the user in order to rotate the impeller wheel with the pedals.

10. The apparatus as defined in claim 9 wherein the frame is adapted to accommodate a limited side-to-side shift of the frame during use of the apparatus.

11. The apparatus as defined in claim 9 further comprising means for snugly holding the feet of the user against the pedals during rotation of the impeller wheel about the axis of rotation.

12. A cycle-type exercise or therapy apparatus for use in water contained within a pool having walls, the apparatus comprising:

a frame securable adjacent a wall of the pool and in a relatively stationary condition with respect to the walls of the pool; and an impeller section including an impeller wheel rotatably attached to the frame for rotation relative thereto about an axis of rotation and a pair of rotatable pedals associated with the impeller wheel with which the impeller wheel can be rotated about the axis of rotation in conjunction with the movement of the user's feet;

the impeller wheel being adapted to move the water of the pool through the impeller section as the impeller wheel is rotated as aforesaid and including means defining an opening through which a stream of the water is drawn into the impeller section;.

means associated with the inlet of the impeller wheel for regulating the quantity of the stream of water permitted to be drawn into the impeller section to thereby regulate the resistance encountered by the user in order to rotate the impeller wheel with the pedals; and means for snugly holding the feet of the user against the pedals during rotation of the impeller wheel about the axis of rotation wherein the means for snugly holding includes a distensible envelope associated with each pedal wherein the distensible envelope has an interior, and the apparatus further includes means for expanding the envelope to a condition at which the foot of the user is captured by the holding means so that the foot of the user is maintained upon the pedal.

13. The apparatus as defined in claim 12 further comprising means associated with the pedals for expanding the envelope with water in response to the rotation of the pedals about an axis of rotation.

14. The apparatus as defined in claim 1 wherein the impeller is adapted to be directly driven by a limb of a user as the user's limb is moved along a circular path so that the movement of the user's limb through a single revolution along the circular path effects the rotation of the impeller wheel through a single revolution.

15. The apparatus as defined in claim 1 wherein the inlets provided in the opposite side plates of the impeller are substantially of equal size.

* * * * *